US009336698B2

(12) United States Patent
Monti

(10) Patent No.: US 9,336,698 B2
(45) Date of Patent: May 10, 2016

(54) FLASHING LED MESSAGE BOX

(71) Applicant: Peter J Monti, Cumming, GA (US)

(72) Inventor: Peter J Monti, Cumming, GA (US)

( * ) Notice: Subject to any disclaimer, the term of this patent is extended or adjusted under 35 U.S.C. 154(b) by 0 days.

(21) Appl. No.: 14/568,262

(22) Filed: Dec. 12, 2014

(65) Prior Publication Data

US 2015/0096210 A1 Apr. 9, 2015

Related U.S. Application Data

(63) Continuation of application No. 14/135,129, filed on Dec. 19, 2013, now abandoned, which is a continuation of application No. 13/713,823, filed on Dec. 13, 2012, now abandoned, which is a continuation of application No. 12/834,656, filed on Jul. 12, 2010, now abandoned.

(60) Provisional application No. 61/225,305, filed on Jul. 15, 2009.

(51) Int. Cl.

| | |
|---|---|
| ***G09F 13/04*** | (2006.01) |
| ***G09F 9/33*** | (2006.01) |
| ***G09F 19/22*** | (2006.01) |
| ***G09F 13/00*** | (2006.01) |

(52) U.S. Cl.

CPC ..... *G09F 13/0413* (2013.01); *G09F 9/33* (2013.01); *G09F 13/005* (2013.01); *G09F 13/04* (2013.01); *G09F 19/22* (2013.01)

(58) Field of Classification Search

CPC ..... G09F 13/04; G09F 13/0413; G09F 2013/0445

See application file for complete search history.

(56) References Cited

U.S. PATENT DOCUMENTS

| | | | | |
|---|---|---|---|---|
| 4,575,782 | A * | 3/1986 | Levine et al. | 362/503 |
| 5,778,579 | A * | 7/1998 | Yuen | 40/564 |
| 6,367,180 | B2 * | 4/2002 | Weiss et al. | 40/580 |
| 8,646,194 | B2 * | 2/2014 | Podd | 40/578 |
| 2002/0112026 | A1 * | 8/2002 | Fridman | A61K 38/2221 709/217 |

* cited by examiner

*Primary Examiner* — Cassandra Davis

(74) *Attorney, Agent, or Firm* — Smith Tempel; Gregory Scott Smith

(57) ABSTRACT

A message box for presenting messages, such as advertising material to target consumers. The message box is suitable for being integrated into existing infrastructure. Further, the message box includes an electronic illumination source that can be pulsed on or off, and at varying intensity levels so as to maximize or increase the ability to attract the attention of the target consumers. Other controls can be applied in operation of the illumination sources so as to create additional attractions to target consumers. The messages can be manually or automatically changed.

18 Claims, 2 Drawing Sheets

FLASHING LED MESSAGE BOX

CROSS-REFERENCE TO RELATED APPLICATIONS

This application is being filed under 35 USC 111 and 37 CFR. 1.53(b) as a United States non-provisional application for patent and, is a continuation of the United States Patent Application that was filed on Dec. 19, 2013 and assigned Ser. No. 14/135,129, which application is a continuation of the United States Patent Application that was filed on Dec. 13, 2012 and assigned Ser. No. 13/713,823, which application is a continuation of the United States Patent Application that was filed on Jul. 12, 2010 and assigned Ser. No. 12/834,656, which application claims the benefit of the prior filing date of the United States provisional application for patent that was filed on Jul. 15, 2009, assigned Ser. No. 61/225,305 and bearing the title of FLASHING LED MESSAGE BOX, which applications are incorporated herein by reference in their entirety, and thus this application claims a priority date of at least Jul. 15, 2009.

BACKGROUND

As Mark Twain once said "many a small thing has been made large by the right kind of advertising". The question that then plagues the world is "what is the 'right kind' of advertising?" Over the years this has changed drastically and to a large extent, the changes have at a minimum, been influenced by the development of technology. But, one truth that is difficult to deny is that to sell a product or service, you must capture the attention of the potential consumers.

Various techniques have been used to capture the attention of potential consumers in a variety of settings, including colorful ads in magazines and newspapers, billboards along roadways, commercials interjected into broadcasted audio or video content, flyers received in the mail, posters on the inside and outside of public transportation, pop-up windows in web browser, etc. Thus, it is common to find advertisement efforts being expended in areas in which significant consumer traffic is anticipated and, in which the attention of the consumers can be captured.

One area that has not been fully exploited is drive-thru traffic at various establishments, such as fast food restaurants, dry cleaners, banks, car washes, gas station pumps, etc. Thus, there is a need in the art for a technique to conveniently and efficiently attract the attention of consumers in such settings and to present advertising information to them.

One issue with regards to presenting advertisements at such places is that many of the establishments are already in existence. For established businesses, it can be costly to go in and retrofit the system to include a dedicated advertising medium. In such scenarios, it is advantageous to have a technique that presents advertisements that can be easily and cost effectively integrated into the existing establishment.

Another issue with public advertising is that it can easily become background visual noise and thus, not captivate the attention of the target consumers. In view of this, it is desirable to have an advertising medium that draws the attention of a target consumer.

Therefore, there is a need in the art for an advertising medium that can be easily deployed in established businesses or integrated into new designs, and that operates to capture the attention of targeted consumers.

BRIEF SUMMARY

The present disclosure is focused on an advertising medium in the form of a message box that addresses the above-mentioned needs in the art as well as other needs. In one embodiment, the message box includes an illumination source, such as an LED, an array of LEDs or other illumination sources, that project light energy generally towards a diffuser/lens component. The diffuser/lens component houses the advertisement material which could include a variety of structures. A few non-limiting examples include etchings on the lens, silk screening on the lens, medium inserted between the lens/diffuser or attached or otherwise associated with the diffuser/lens component. For instance, a vinyl or transparency type material that is at least partially translucent and/or potentially opaque in other areas can be affixed to or associated with the diffuser/lens such that the illumination energy passes through the medium and shows the information content. As another example, a stencil type vinyl material can be used and applied to the substrate (diffuser/lens). In some embodiments, the vinyl material may include elements that are removed and attached to the substrate and in other embodiments, elements can be removed from the vinyl material and then the stencil like material applied to the substrate.

The light source and diffuser/lens component can be mounted in a box enclosure that includes or is attached to a mounting bracket. In some embodiments the mounting bracket may be fixed at a particular angle, other embodiments may allow the mounting bracket to adjust between two or more discrete positions or angles and yet in other embodiments, the mounting bracket may allow continuous adjustment of the box enclosure in both the up and down directions and/or the left and right directions.

In some embodiments, the message box maybe operated based on rechargeable battery voltage sources and may utilize photovoltaic cells for recharging of the batteries. In such embodiments, the message box can conveniently be integrated into existing infrastructure with minimal impact. However, in other embodiments, other power sources including DC and AC power sources may be used to power the device.

In an exemplary embodiment, the message box can receive an advertising message and then once turned on, begin to turn on and off the illumination source in a manner to attract the attention of a customer. In some embodiments, the message box may include a microprocessor with memory and control circuitry, or a microcontroller, that is used to execute a software program to control the illumination source. In other embodiments, hardware components can be used to achieve desired effects of the illumination operation. For instance, in either embodiment, an exemplary embodiment may cause the illumination to fluctuation from bright to dark (or on to off) at one second intervals. In other embodiments, the intervals can be adjusted based on a variety of factors including, but not limited to, time of day, brightness of ambient light, amount of information displayed, particularities of the application or environment, statistical data related to the rate at which target consumers pass by the message box or the amount of time that they are exposed to the message box, adjustable based on detected light or illumination fluctuations in the vicinity, etc. For instance, the message box may include one or more light sensors to determine how bright the vicinity is and control the illumination brightness of the illumination source accordingly. In addition, the message box may identify light fluctuations in the vicinity of the message box and ensure that the rate at which the message box cycles the light stages is such to maximize attention from target customers. For instance, if other lights sources are flashing at one rate, the message box may operate to ensure that it is fluctuating at either a faster or slower rate to maximize the ability to capture the target consumer's attention.

In some embodiments, a faceplate may be attached to the outside or the front of the message box to help it to aesthetically fit into the installed environment and/or to fit properly in the installation site and/or to provide weather resistance. In addition, some embodiments include a structure to allow the faceplate, lens and/or diffuser to be easily removed to facilitate the changing of the advertisement information. In some embodiments, the faceplate may also include illumination elements, such as LEDs to help attract attention. For instance, the LEDs on the face plate can be flashed, scrolled or adjusted to help facilitate the capture of a target consumer's attention.

In some embodiments the illumination source may be a single color, such as white, red, yellow, green, etc. as a non-limiting example. In other embodiments, multiple illumination sources of differing colors may be used so as to change the primary display play color, alternate between different colors, etc. In addition, in some embodiments, an array of various colors may be used to create a wide range of color potential. For instance, illumination sources that can provide standard red, green and blue (RGB) colors could be used to then create any of a variety of colors and hues for the message box. In other embodiments, the illumination source can be controlled to create varying light patterns. For instance, waves of high and low intensity lights can be created by changing the intensity levels of individual light sources or groups of light sources.

Some embodiments of the message box may also include audible sources that can be used to further capture the attention of the target consumers. The audible source may simply be a buzzer, bell or tweeter, but in other embodiments, actual speakers rendering audio, such as speech and/or music can be utilized.

In yet other embodiments, the message box may partition the advertising space into multiple partitions with each partition presenting different, either related or unrelated advertising content. In such an embodiment the illumination source can be operated to illuminate the entire display area at once or, it may target specific partitions at a time. As such, each partition may be independently controlled such that the illumination source may illuminate that partition at different rates and/or intensities.

In some embodiments, the advertising content can be automatically changed at a rate. For instance, the advertising content may be on a scroll that is automatically fed through the display region at a particular and/or selectable/settable rate. In such an embodiment, the advertising material can automatically be updated and or cycle through the content. As a non-limiting example, the advertising content can be automatically changed based on the time of day. In such an embodiment, one advertisement may be displayed during one period of time, and a different advertisement displayed during a different period of time (i.e., morning consumers may be targeted differently than afternoon consumers). Various technologies may be used to cycle through the content and each such technique could be incorporated into various embodiments of the message box. As a non-limiting sample, a loop of advertising content can be periodically scrolled through the display region.

DETAILED DESCRIPTION OF EMBODIMENTS

The present disclosure is directed towards various embodiments of a message box, as well as features and aspects thereof, which can be used, among other uses, to present advertising to customers at drive-thru commercial establishments. The present detailed description is of the best currently contemplated modes of carrying out exemplary embodiments of the message box. It should be appreciated that the present description of the various embodiments, features and aspects of the message box is not to be taken in a limiting sense, but rather, is made merely for the purpose of illustrating the general principles of the various embodiments.

In general, various embodiments provide a flashing message box adapted for use in presenting an advertisement to customers at drive-thru commercial establishments.

The following elements are presented in the attached drawings and are defined more fully within the detailed description:

10: is the overall environment and deployment of an embodiment of the message box.
12: is an LED engine.
14: is a light diffuser.
16: is a graphic lens.
18: is a universal mounting bracket.
20: is a box enclosure.
22: are angle brackets.
24: is a face plate.
26: are the threaded inserts.
28: is a drive through window.
30: is a fast food restaurant.
32: is a menu/order board.
34: is a drive through lane.
36: are pop rivets.
38: is a photocell opening or aperture.
40: are graphic panel dimple stops.
42: are side key slots.
44: are internal diffuser and lens stops.

Figure 1:
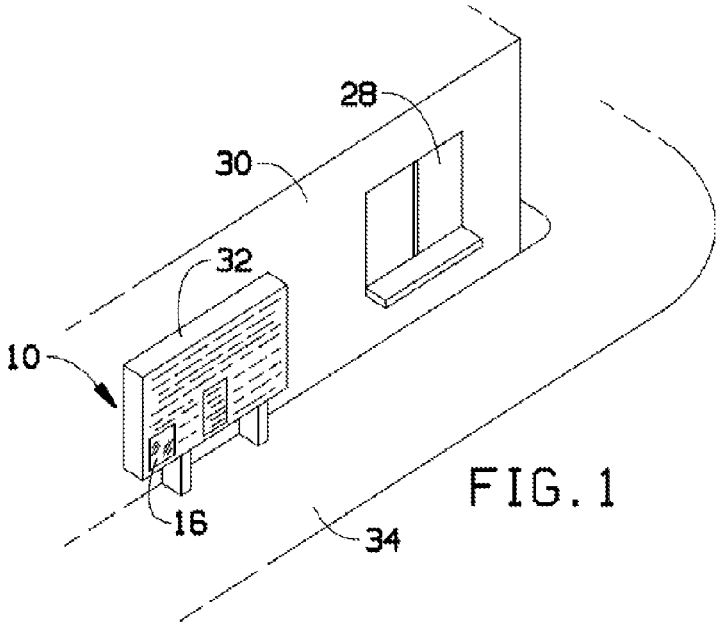
FIG. 1 is a perspective view of a suitable environment for various embodiments of the message box.
Figure 2:
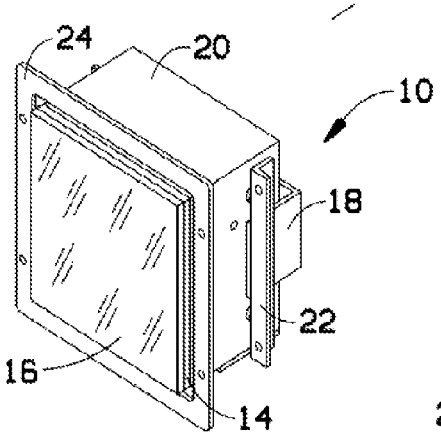
FIG. 2 is a perspective view of an exemplary embodiment of the invention 10.
Figure 3:
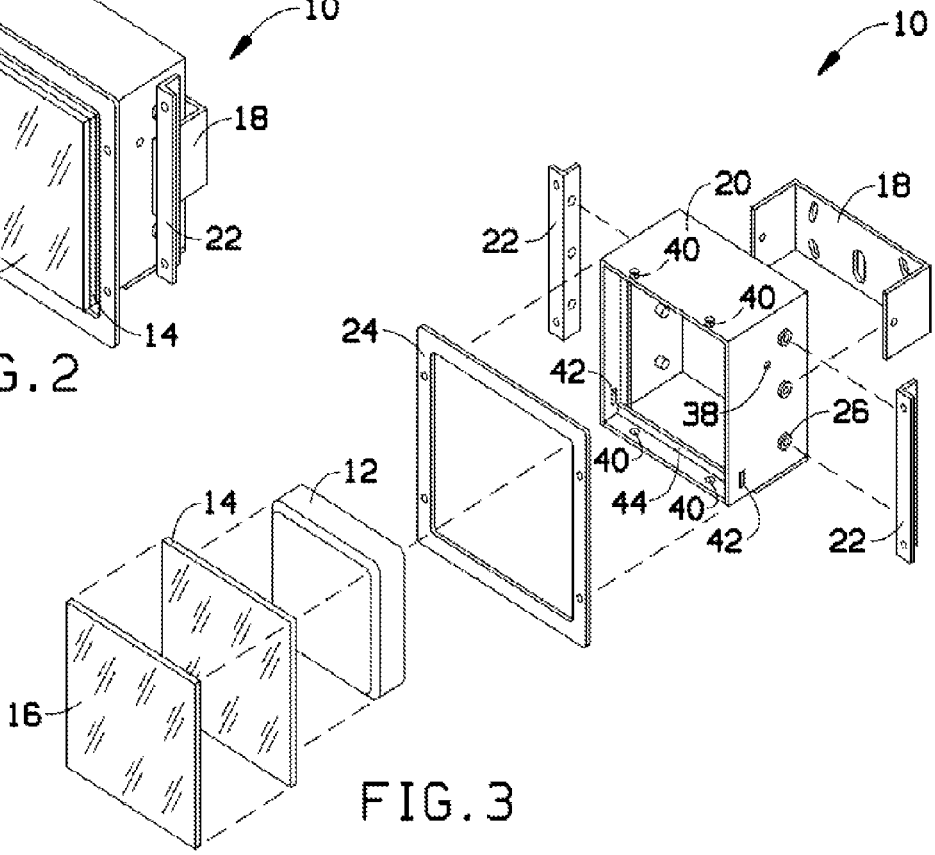
FIG. 3 is an exploded view of an exemplary embodiment of the invention 10.
Figure 4:
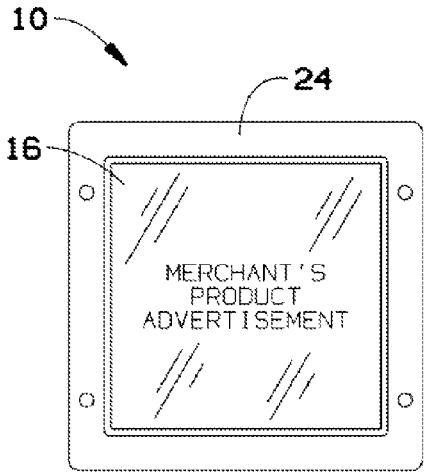
FIG. 4 is a front view of an exemplary embodiment of the invention 10.
Figure 5:
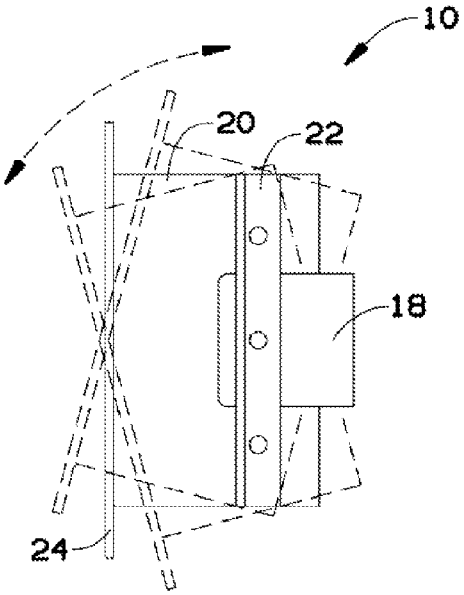
FIG. 5 is a side view of an exemplary embodiment of the invention 10.

FIG. 1 is a perspective view of a suitable environment for various embodiments of the message box. As illustrated, the message box 10 can be incorporated into a drive-thru menu screen or display 32. Embodiments of the message box comprise an LED light source 12 or similar light source; a graphic lens 16 that holds a message; and a box enclosure 20 that contains the light source and lens. In exemplary embodiments (FIGS. 2,3) the message box further comprises a light diffuser lens 14 that enhances the display of the graphic lens 16, and a means to mount the box enclosure 20 in the selected site, for example, the menu board and ordering station 32 in a drive-thru restaurant 30. The message box device 10 may also comprise a photocell or photo-sensor flasher circuit, which would control the LED light source. For instance, the photocell may be interfaced to a controller or circuit such that depending on the readings from the photocell, the light source can be controlled. Non-limiting examples of such control may include dimming the lights when the ambient light is low, brightening the lights when the ambient light is high (i.e., changing the light source inversely proportionate to the ambient light intensity around the box), flashing the lights at different rates based on fluctuations in the ambient light, etc.

Figure 7:
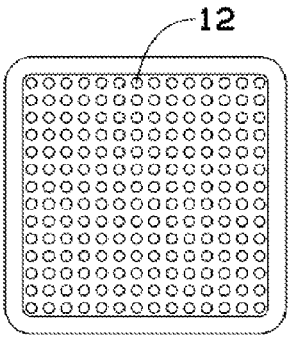
FIG. 7 is a front view of the LED light engine in an exemplary embodiment of the invention 10.

The LED light engine 12 (FIG. 7) can have a single LED or rows of LEDs. LED's could be red or white/clear in color. Alternatively, the light engine could be an LCD backlight source. The light engine is connected to a power source and, where necessary, a transformer. A programmable photocell flasher circuit controls the operation of the LED light engine or similar light source. When used in outdoor locations, the LED light engine 12 is weather resistant and is equipped with a damp location power supply.

Figure 6:
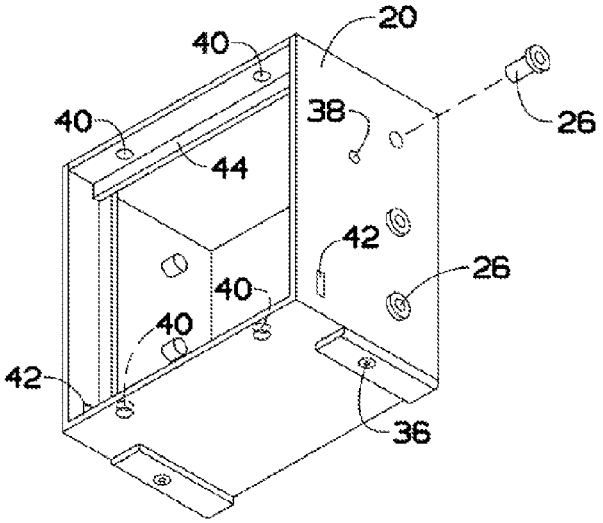
FIG. 6 is a perspective view of the box enclosure in an exemplary embodiment of the invention 10.

The photocell flasher circuit can be designed for incorporation into the PCB (printed circuit board) of the light engine. Alternatively, it is incorporated into its own module wherein the photocell is placed on its own PCB and mounted separately at an opening 38 in the box enclosure 20 (FIG. 6) provided for that purpose. The photocell flasher circuit provides a programmable flash rate to the LED light engine 12 as well as providing dimming capability of the light source. The flash rate can be selected. In an exemplary embodiment, the flash rate is a tested rate of 1 second ON and 1 second OFF. The flash rate preferably alternates 3 times and pauses for 2.5 to 3 seconds. After the pause, then the flashing can resume or repeat for another cycle. If used in an outdoors installation, the photocell portion of the circuit provides that the light source is bright enough for excellent viewing of the message on the message panel 16 during daylight hours and dims for excellent viewing during night time hours. The ability to dim and brighten is also useful in inside installations where the ambient lighting conditions are variable. The photocell flasher circuit could have many variations to the design, as it is an electronic circuit. The most important functions are the programmable flash rate and the ability to dim and brighten the light engine for various ambient lighting conditions.

The graphic lens 16 is a piece of anti-glare plastic, which holds and displays the message. The message is applied by a vinyl sticker application, a direct printing process, or alternatively, the graphic lens can sandwich the message between two graphic lenses. The graphic lens 16 has notches on the bottom of the panel that allow any flat object, such as a key or screwdriver to remove the lens for replacement. The preferred thickness of the graphic lens is from about 3/16 to 1/16 inches; however the preferred size would be 1/8 inch. The graphic lens could be thinner or thicker depending on the various applications. Full color graphics could also be applied to this design.

Various embodiments of the message box may also comprise a light diffuser lens 14 to provide maximum light diffusion to maximize the full graphic lens area. The diffuser lens is placed strategically in front of the light source for the optimum viewing of the message on the graphic lens 16. Depending on 20 the characteristics of the light engine, it would be possible to eliminate the diffuser and reduce costs.

The components of the flashing message display are housed in a box enclosure 20 that has a number of specialized features. It has a small compact overall design that allows it to fit in existing drive-thru applications 28 and menu board systems 32. Graphic panel dimple stops 40 are illustrated on the two top edges and two bottom edges of the box 20 to hold the graphic panel 16 in place. These stops are rounded for easy movement of the graphic panel over them, and the box is designed to open up or stretch so that the graphic lens panel 16 can move over the dimple stops more easily. For instance, in one embodiment the box is designed to open in a jaw-like manner such that the lower or bottom edge gives more when pressure is applied during the insertion or removal of the lens panel 16. To create this feature, the box may include a mechanical element that allows the jaw to open or, it may be manufactured to have some ability to be deformed, either by choice in material, structure design (i.e., thin material, slotted, etc) or a combination of both. For instance, if slots are cut or included in the surface of the box, then flanges that can be forced out are created. In any of the variety of such embodiments, when pressure is applied to the box, such as when the lens 16 is being inserted, then the box slightly deforms to facilitate insertion of the lens 16. When the pressure is then subsequently removed, the box returns to its normal position and thus securely holds the lens 16 in place. The dimple stop shape can be of a variety of shapes but, by making the dimples such that from the front to the rear and rear to the front the dimple is rounded as in a bell shape, the front panel can more easily be inserted and removed. As a non-limiting example, the dimple shape may be tubular and run along the top and bottom, or simply a protrusion, etc. But, in any of the various shapes, rounding the shape of the stops from front to rear and rear to front (such as a bell shape) advantageously allows the graphic panel to be removed and replaced easily. It should be appreciated that the dimples can be included on one or more surfaces of the box but, the illustrated embodiment shows the dimples on the inside of the lower and upper edges of the box. It should also be appreciated that in addition, or alternatively, to the dimples, other mechanisms may also be used to secure the lens 16 to the box. For instance, the faceplate 24 may include an opening that is smaller than the lens 16 and is used to hold the lens 16 to the box. Other mechanisms such as clamps, springs, screws, etc. may also be used.

It should be appreciated that various configurations and assemblies of the message box can be used in different embodiments. However, in the illustrated embodiment, the main enclosure 20 is opened on the front and back sides. The lip or rim 44 extends around the inner surface of the enclosure 20 and is proximate to the front of the box opening. The dimples 40 are positioned in front of the rim 44 at a distance sufficient to hold the lens 14 either against the lip 44, or the diffuser 14 if the diffuser is installed between the lip 44 and the lens 16. The light source 12 is installed behind the lip 44. It should be appreciated that the light source 12 may include the other electronics, such as the processor, circuits, interface to power source, interface to sensors/detectors, etc or, a separate module containing the same be inserted into the enclosure.

The strategically placed key slots 42 in the bottom sides of the box allow for an alternate way to remove the graphic panel. Multiple and strategically placed fasteners 36 allow the enclosure to open up or stretch for easy graphic panel exchange. A photocell hole 38 allows the photocell to receive ambient outside light levels for proper light intensity setting of the light engine. Internal lens stops 44 allow correct spacing for the diffuser lens 14 and graphic lens 16 placements. A face plate 24 on the front of the box enclosure allows for flush mounting installation on an existing order station or other enclosure. The box enclosure 20 could be made of aluminum formed construction, injection molding of aluminum or plastic, or any other appropriate forming process, as well as a vacuum forming process. However, the unique features of the box listed above would still need to apply for proper installation.

The current mounting bracket design 18, 22, 24 and mounting screw locations 26 in the box give the most practical mounting application; however, additional holes could be placed in the box for other mounting methods. A flush mount adapter kit provides various ways to install the box 20 in existing drive-thru menu boards 32 and order stations as well as other enclosures. Brackets 18, 22, 24 align with the design of the box for multiple installation applications. Depending on a specific installation application, other universal mounting kits could be made to connect with the existing box mounting methods.

Various embodiments of the message box could be made by a manufacturer with various skill sets known to those in the manufacturing arts: mechanical methods for the box design, and lens designers and electronics technicians for the photocell flasher and light source design. Graphic design skills are also necessary for applying the message on the graphics panel.

Other embodiments, in which the power to supply the functions of the flashing message box is supplied by a solar panel and rechargeable battery source are contemplated. This arrangement would eliminate the need for a transformer directly connected to the light engine. In yet other embodiments, having a metal or plastic disk that would spin at a rate to reproduce the flashing effect could replicate the flashing message box, as could a computer programmed to provide a flashing voltage output.

Both of these possibilities would still need a flashing light source of some type with a photocell and would cause different installation requirements. The flashing message box could be used in many other applications, for example, banks, gas stations, food store end caps and isles, anywhere people gather and a store owner wants to get a message out to sell products.

Businesses want to sell more products to customers while they are in the drive-thru lanes 34 at fast food restaurants 30, banks and gas stations, for example. There are plenty of distractions at these locations and the customers have a limited attention span. Various embodiments of the flashing message box may deliver aprecise single message which is more apt to generate a positive reaction or, be more effective. The flashing message box provides an easy single message approach combined with a tested timed flash rate which gets the viewer to respond to the product advertised or offer presented. It is anticipated therefore that when the business owner has the device installed in their drive-thru location 28 with a message graphic displayed on it, those who read it will respond to it at a higher rate than to other advertising products.

It should be understood, of course, that the foregoing relates to exemplary embodiments and that modifications may be made without departing from the spirit and scope of the invention as set forth in the following claims.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

In this application the words "unit" and "module" are used interchangeably. Anything designated as a unit or module may be a stand-alone unit or a specialized module. A unit or a module may be modular or have modular aspects allowing it to be easily removed and replaced with another similar unit or module. Each unit or module may be any one of, or any combination of, software, hardware, and/or firmware.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An apparatus for presenting messages for viewing by consumers passing in proximity to the apparatus, the apparatus comprising:

a box enclosure having an open side;

an electronic light source configured to be positioned within the interior of the box enclosure, wherein the electronic light source is an array of LEDs and the controller can independently adjust the intensity levels of individual LEDs or groups of LEDs;

a graphic lens configured to fit within the open side of the box enclosure; and a controller configured to dynamically control the intensity of the electronic light source between a plurality of on values based on a first set of environmental conditions and to alter a rate of change of the electronic light source between at least two intensity levels based on a second set of environmental conditions.

2. The apparatus of claim 1, wherein the array of LEDs comprises LEDs of at least two different colors and the controller is further configured to adjust the intensity of the LEDs to create waves of intensity by adjusting individual LEDs.

3. The apparatus of claim 1, wherein the controller reads instructions from a memory element and executes instructions.

4. The apparatus of claim 1, further comprising a device to measure light proximate to the apparatus and the controller is further configured to control the light source based at least in part on the measured light.

5. The apparatus of claim 4, wherein the box enclosure is structured to deform slightly under pressure by being constructed of a material that enables the box enclosure to be deformed.

6. The apparatus of claim 4, wherein the box enclosure is structured to deform slightly under pressure by including slots that allow the box enclosure to be deformed.

7. The apparatus of claim 6, wherein the controller is configured to dim or brighten the light source inversely proportionate to the light source intensity proximate to the apparatus.

8. The apparatus of claim 1, wherein the apparatus includes a light sensor and the first set of environmental conditions includes one of the environmental conditions from the set of conditions including the time of day, the brightness of ambient light, the amount of information displayed, statistical data related to the rate at which consumers pass by the apparatus, the illumination fluctuations of other lights detected in the vicinity.

9. An apparatus for presenting messages for viewing by consumers passing in proximity to the apparatus, the apparatus comprising:

a box enclosure having an open side;

an electronic light source configured to be positioned within the interior of the box enclosure;

a graphic lens configured to fit within the open side of the box enclosure; and a controller configured to dynamically control the intensity of the electronic light source between a plurality of on values based on a first set of environmental conditions and to alter a rate of change of the electronic light source between at least two intensity levels based on a second set of environmental conditions, wherein the message is provided on a medium that is placed proximate to a surface of the lens.

10. The apparatus of claim 9, wherein the medium includes multiple messages and, the medium can be automatically changed between a first message and a second message.

11. The apparatus of claim 9, wherein the controller is configured to control the light source so as to illuminate different partitions of the graphic lens.

12. An apparatus for presenting messages for viewing by consumers passing in proximity to the apparatus, the apparatus comprising:

a box enclosure having an open side;

an electronic light source configured to be positioned within the interior of the box enclosure;

a graphic lens configured to fit within the open side of the box enclosure;

a controller configured to dynamically control the intensity of the electronic light source between a plurality of on values based on a first set of environmental conditions and to alter a rate of change of the electronic light source between at least two intensity levels based on a second set of environmental conditions; and a light intensity detector and wherein the controller is configured to interface to the electronic light source and the light intensity detector and to set the intensity of the electronic light source inversely proportionate to ambient light based at least in part on readings from the light intensity detector.

13. The apparatus of claim 12, wherein the box enclosure is structured to deform slightly under pressure by being constructed of a material that enables the box enclosure to be deformed.

14. The apparatus of claim 12, wherein the box enclosure is structured to deform slightly under pressure by including slots that allow the box enclosure to be deformed.

15. An apparatus for presenting messages for viewing by consumers passing in proximity to the apparatus, the apparatus comprising:

a box enclosure having an open side;

an electronic light source configured to be positioned within the interior of the box enclosure;

a graphic lens configured to fit within the open side of the box enclosure; and a controller configured to dynamically control the intensity of the electronic light source between a plurality of on values based on a first set of environmental conditions and to alter a rate of change of the electronic light source between at least two intensity levels based on a second set of environmental conditions, wherein the apparatus includes a light sensor and the rate of change is approximately one second and the second set of environmental conditions includes one of the environmental conditions from the set of conditions including the time of day, the brightness of ambient light, the amount of information displayed, statistical data related to the rate at which consumers pass by the apparatus, the illumination fluctuations of other lights detected in the vicinity.

16. An apparatus for presenting messages for viewing by consumers passing in proximity to the apparatus, the apparatus comprising:

a box enclosure having an open side;

an electronic light source configured to be positioned within the interior of the box enclosure;

a graphic lens configured to fit within the open side of the box enclosure; and a controller configured to dynamically control the intensity of the electronic light source between a plurality of on values based on a first set of environmental conditions and to alter a rate of change of the electronic light source between at least two intensity levels based on a second set of environmental conditions, wherein the apparatus includes a light sensor and the second set of environmental conditions comprises the illumination fluctuations of other lights detected in the vicinity and the controller configured to dynamically alter the rate of change to be at a different rate than the illumination fluctuations of other lights detected in the vicinity, whereby the apparatus will draw attention of consumers in the vicinity of the apparatus.

17. An apparatus for presenting messages for viewing by consumers passing in proximity to the apparatus, the apparatus comprising:

a box enclosure having an open side;

an electronic light source configured to be positioned within the interior of the box enclosure;

a graphic lens configured to fit within the open side of the box enclosure; and a controller configured to dynamically control the intensity of the electronic light source between a plurality of on values based on a first set of environmental conditions and to alter a rate of change of the electronic light source between at least two intensity levels based on a second set of environmental conditions, wherein the apparatus includes a light sensor and the first set of environmental conditions includes one of the environmental conditions from the set of conditions including the time of day, the brightness of ambient light, the amount of information displayed, statistical data related to the rate at which consumers pass by the apparatus, the illumination fluctuations of other lights detected in the vicinity and the second set of environmental conditions comprises the illumination fluctuations of other lights detected in the vicinity and the controller configured to dynamically alter the rate of change to be at a different rate than the illumination fluctuations of other lights detected in the vicinity, whereby the apparatus will draw attention of consumers in the vicinity of the apparatus.

18. An apparatus for presenting messages for viewing by consumers passing in proximity to the apparatus, the apparatus comprising:

a box enclosure having an open side;

an electronic light source configured to be positioned within the interior of the box enclosure;

a graphic lens configured to fit within the open side of the box enclosure; and a controller configured to dynamically control the intensity of the electronic light source between a plurality of on values based on a first set of environmental conditions and to alter a rate of change of the electronic light source between at least two intensity levels based on a second set of environmental conditions, wherein the apparatus includes a light sensor and the first set of environmental conditions includes the ambient light proximate to the apparatus and the intensity of the electronic light source is set at a level that is inversely proportionate to ambient light and the second set of environmental conditions comprises the illumination fluctuations of other lights detected in the vicinity and the controller configured to dynamically alter the rate of change to be at either a faster or a slower rate than the illumination fluctuations of other lights detected in the vicinity, whereby the apparatus will draw attention of consumers in the vicinity of the apparatus.

* * * * *